US006403909B1

(12) United States Patent
Green et al.

(10) Patent No.: US 6,403,909 B1
(45) **Date of Patent: *Jun. 11, 2002**

(54) TRIP OVERRIDE FOR ROTARY BREAKER

(75) Inventors: Randall Green, Granby; Roger Castonguay, Terryville; Dave Christensen, Harwinton; Girish Hassan, Planville, all of CT (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/523,900

(22) Filed: Mar. 13, 2000

(51) Int. Cl.[7] ..... H01H 9/44

(52) U.S. Cl. ..... 218/22; 335/16; 335/172; 335/166

(58) Field of Search ..... 335/8–10, 168–176, 335/185–195, 202; 218/22; 200/244–245, 400, 401

(56) References Cited

U.S. PATENT DOCUMENTS

| | | | | |
|---|---|---|---|---|
| 4,346,358 A | | 8/1982 | Heft | 335/16 |
| 4,616,198 A | | 10/1986 | Pardini | |
| 4,672,501 A | | 6/1987 | Bilac et al. | |
| 4,916,421 A | * | 4/1990 | Pardini et al. | 335/185 |
| 5,030,804 A | * | 7/1991 | Abri | 200/323 |
| 5,103,198 A | | 4/1992 | Morel et al. | 335/6 |
| 5,310,971 A | * | 5/1994 | Vial et al. | 335/16 |
| 5,351,024 A | | 9/1994 | Juds et al. | 335/16 |
| 6,049,051 A | * | 4/2000 | Dosmo et al. | 218/155 |
| 6,084,191 A | * | 7/2000 | Kataya et al. | 200/401 |

FOREIGN PATENT DOCUMENTS

| | | | |
|---|---|---|---|
| EP | 0 455 564 A1 | | 11/1991 |
| EP | 889498 | * | 6/1998 |
| FR | 2 305 010 A | | 10/1976 |

* cited by examiner

*Primary Examiner*—Lincoln Donovan
(74) *Attorney, Agent, or Firm*—Cantor Colburn LLP

(57) ABSTRACT

A circuit breaker assembly includes first and second rotary contact assemblies mountable to a base member, a circuit breaker operating mechanism mounted to the first rotary contact assembly, and a trip bar in mechanical communication with the first rotary contact assembly and the circuit breaker operating mechanism. The rotary contact assemblies each include rotors rotatable about axes therethrough and movable contact arms pivotally mounted within the rotors. The circuit breaker operating mechanism serves to position the rotors to separate movable contacts thereon from fixed contacts. A trip override device includes spring links operably connected via springs to each of the rotors of the rotary contact assemblies and the trip bar. The trip bar comprises trip levers protruding radially therefrom and being in mechanical communication with the rotary contact assemblies.

8 Claims, 7 Drawing Sheets

TRIP OVERRIDE FOR ROTARY BREAKER

BACKGROUND OF THE INVENTION

This invention relates to circuit breakers, and, more particularly, to a trip system for a high-level interruption of current that functions as a result of the rotor system of a rotary circuit breaker.

Override systems of the prior art typically use electronic trip units to respond to high-level fault conditions and initiate the separation of all of the contacts in a plurality of rotary circuit poles ganged together to form a multi-pole circuit breaker. For example, in U.S. Pat. No. 4,616,198 entitled "Contact Arrangement for a Current Limiting Circuit Breaker", separate electrodynamic forces may be generated in any of the poles of the circuit breaker causing the contact arms to pivot upon an overcurrent condition. As the contact arms are pivoted, the contacts secured to the arms are separated from the stationary contacts mounted within the circuit breaker, thereby stopping the flow of electric current through the contacts. In that invention, a contact arm associated with one pole of the circuit breaker can open independently of the contact arms associated with the other poles of the circuit breaker. Therefore, the current in only one pole is interrupted upon an overcurrent condition. The override system serves to avoid the occurrence of such "single phasing", where one of the phases interrupts independently of the remaining phases.

Another use of electronic trip units is recited in U.S. Pat. No. 4,672,501 entitled "Circuit Breaker and Protective Relay Unit", which describes the use of electronic circuitry to determine the occurrence of an overcurrent and the use of a current transformer to sense circuit current. However, when using such circuitry in conjunction with rotary contact arrangements, the current transformer cores can become saturated upon occurrence of a short circuit overcurrent and an auxiliary trip unit must be employed to ensure short circuit overcurrent protection.

Short circuit overcurrent protection in rotary contact circuit breakers is also described in U.S. Pat. No. 5,103,198 entitled "Instantaneous Trip Device of a Circuit Breaker", wherein the overpressure developed within a circuit breaker arc chamber upon contact separation in one pole drives a piston against an operating mechanism trip bar to actuate contact separation in the remaining circuit breaker poles. However, it has since been determined that the overpressure response is sensitive to voltage levels upon arc occurrence and that it is less sensitive to short circuit current values.

Electronic methods of contact separation, especially those that operate as the result of magnetic repulsive forces, are slower to respond and thereby increase the time required for a circuit breaker operating mechanism to respond to an overcurrent.

SUMMARY OF THE INVENTION

In the present invention, a circuit breaker assembly includes first and second rotary contact assemblies mountable to a base member, a circuit breaker operating mechanism mounted to the first rotary contact assembly, and a trip bar in mechanical communication with the first rotary contact assembly and the circuit breaker operating mechanism. The rotary contact assemblies each include rotors rotatable about axes therethrough and movable contact arms pivotally mounted within the rotors. The circuit breaker operating mechanism serves to position the rotors to separate movable contacts thereon from fixed contacts. A trip override device includes spring links operably connected via springs to each of the rotors of the rotary contact assemblies and the trip bar. The trip bar comprises a trip rod having trip levers protruding radially therefrom and being in mechanical communication with the rotary contact assemblies.

The above trip override system allows contact separation in one pole to actuate the operating mechanism in all other poles in the circuit breaker. The system has many advantages over the prior art, including that it functions independently of the system voltage by working off the mechanics of the rotor system.

DETAILED DESCRIPTION OF THE INVENTION

Figure 1:
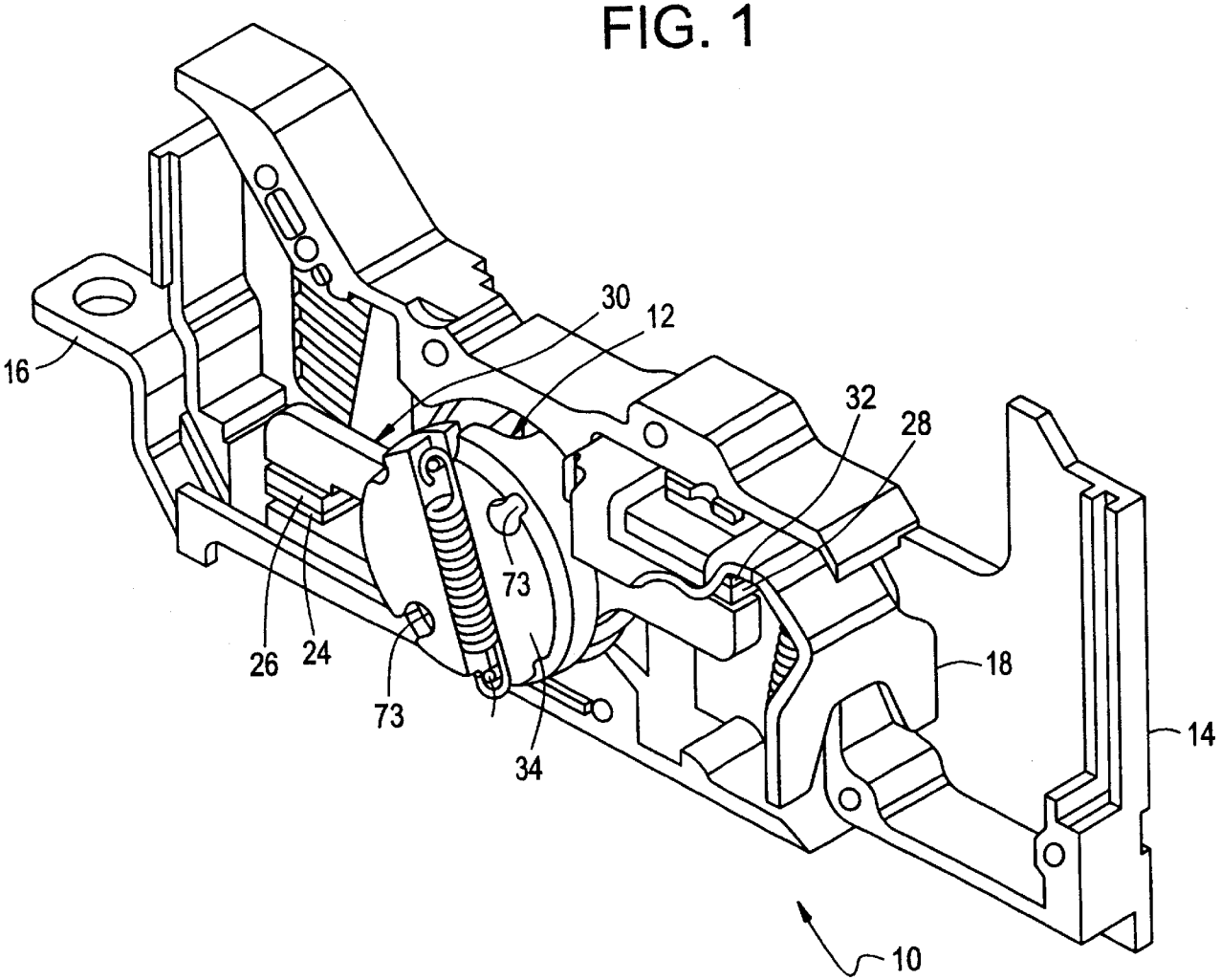
FIG. 1 is a perspective view of a rotary contact assembly.

Referring to FIG. 1, a circuit breaker cassette, shown generally at 10, comprises a rotary contact assembly, shown generally at 12, in an electrically-insulative housing 14 intermediate a line-side contact strap 16, and a load-side contact strap 18. Line-side contact strap 16 is electrically connectable to line-side wiring (not shown) in an electrical distribution circuit, and load-side contact strap 18 is electrically connectable to load-side wiring (not shown) via a lug (not shown) or a device such as a bimetallic element or current sensor (not shown). Although only a single cassette 10 is shown, a separate cassette 10 is employed for each pole of a multi-pole circuit breaker and operated in a manner similar to that of cassette 10.

Electrical transport through rotary contact assembly 12 of cassette 10 occurs from line-side contact strap 16 to an associated fixed contact 24, through movable contacts 26, 28 secured to the ends of a movable contact arm shown generally at 30, and to an associated fixed contact 32 on load-side contact strap 18. Movable contact arm 30 is pivotally arranged between two halves of a rotor 34 and moves in conjunction with rotor 34 upon manual articulation of rotor 34. Rotor 34 is rotatably positioned on a rotor pivot axle (shown below with reference to FIGS. 2 and 3), the ends of which are supported by inner parallel walls of electrically-insulative housing 14.

Figure 2:
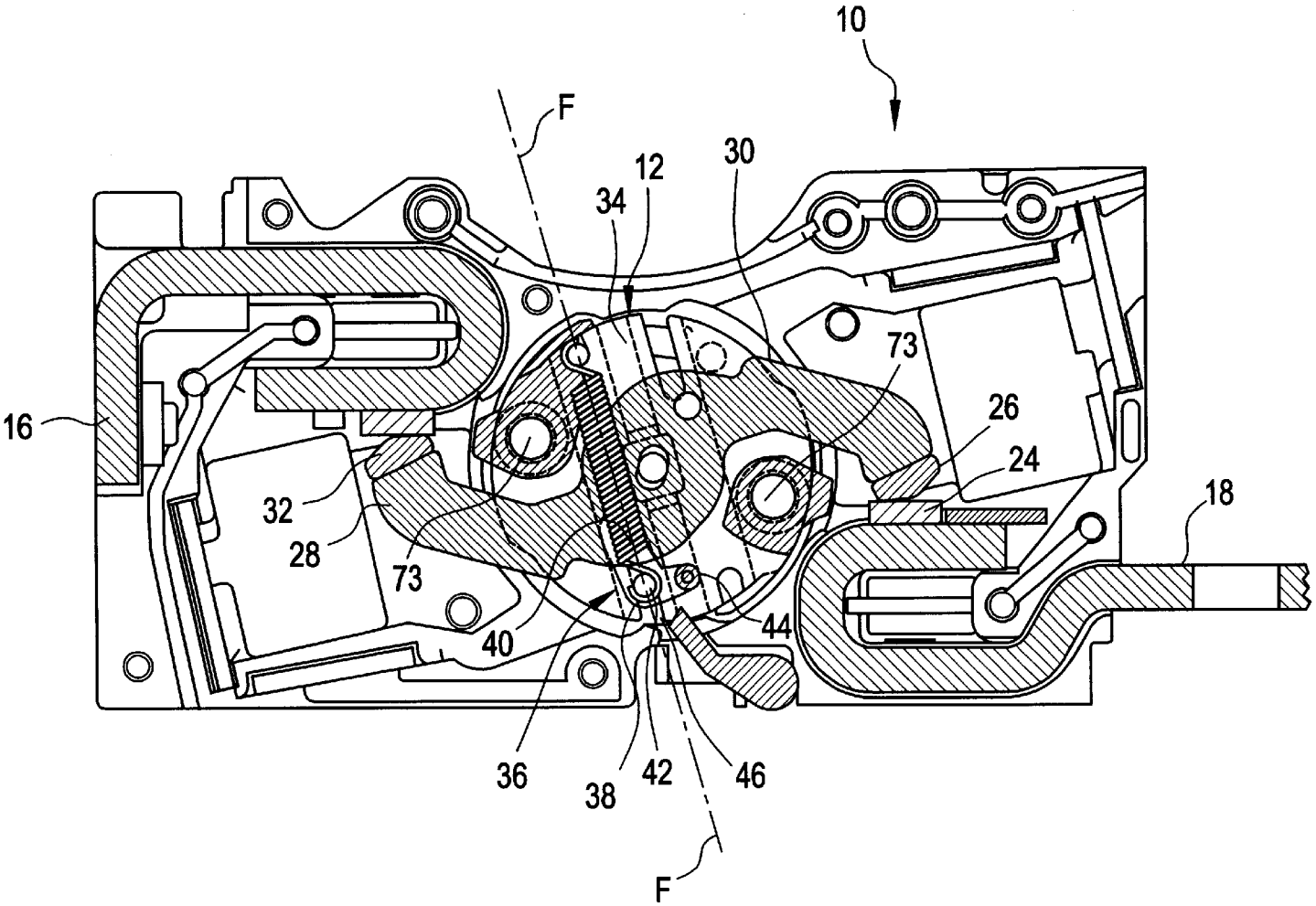
FIG. 2 is a side elevation view of the rotary contact assembly embodying a trip override device, of the present invention, showing the contacts in a closed position.

Referring now to FIG. 2, rotary contact assembly 12 is shown in an "untripped" or "on" position. An inventive spring link is shown generally at 36. Spring link 36 comprises two substantially flat L-shaped members 38 connected at the first ends thereof by a pivot pin 40. Each L-shaped member 38 is pivotally mounted to opposing sides of contact arm 30 using pivot pin 40 and is fixed in a parallel planar relationship with the other by a spring pin 42 and a trip pin 44. Trip pin 44 is fixedly connected to and between the second ends of each L-shaped member 38 and is mechanically communicable with a trip bar 54. Spring pin 42 is positioned intermediate the ends of L-shaped member 38 and extends normally through each L-shaped member 38. Spring pin 42 is captured within rotor 34 via an elongated clearance slot 46 cut into the face of rotor 34 thereby allowing spring link 36 to rotate and translate relative to rotor 34 in the manner described with reference to FIGS. 3 and 4.

A first contact spring 35 stretches across the face of rotor 34. First contact spring is supported on one end by the protrusion of spring pin 42 through slot 46 on the face of rotor 34 and is supported on the other end by a support pin (not shown) on the same face of rotor 34 and located on the perimeter of rotor 34 opposite slot 46. A second contact spring (not shown) is likewise supported on the same face of rotor 34 and is positioned to extend parallel to the first contact spring 35. A third contact spring (not shown) is positioned on the opposing face of rotor 34, is supported by the protrusion of spring pin 42 and the support pin, and functions in the same manner as the first contact spring. A fourth contact spring (not shown) is supported on the opposing face of rotor 34 parallel to the third contact spring. The contact springs are connected to both rotor 34 and contact arm 30 in such a manner so as to bias contact arm 30 into a closed position relative to rotor 34, thereby ensuring an electrically sound connection between fixed contacts 24, 32 and movable contacts 26, 28.

A spring force F is exerted by the first contact spring 35 and the third contact spring to draw spring pin 42 toward the support pin. Force F is transferable to movable contact arm 30 via spring pin 42, spring link 36, and pivot pin 40. If pivot pin 40 is rotated in a clockwise direction about a rotor pivot axle 50, force F causes the rotation of movable contact arm 30 and urges movable contacts 26, 28 toward fixed contacts 24, 32. A second spring force (not shown) is exerted by the second-and fourth contact springs to assist in biasing contact arm 30 such that fixed contacts 24, 32 and movable contacts 26, 28 are engaged.

Figure 3:
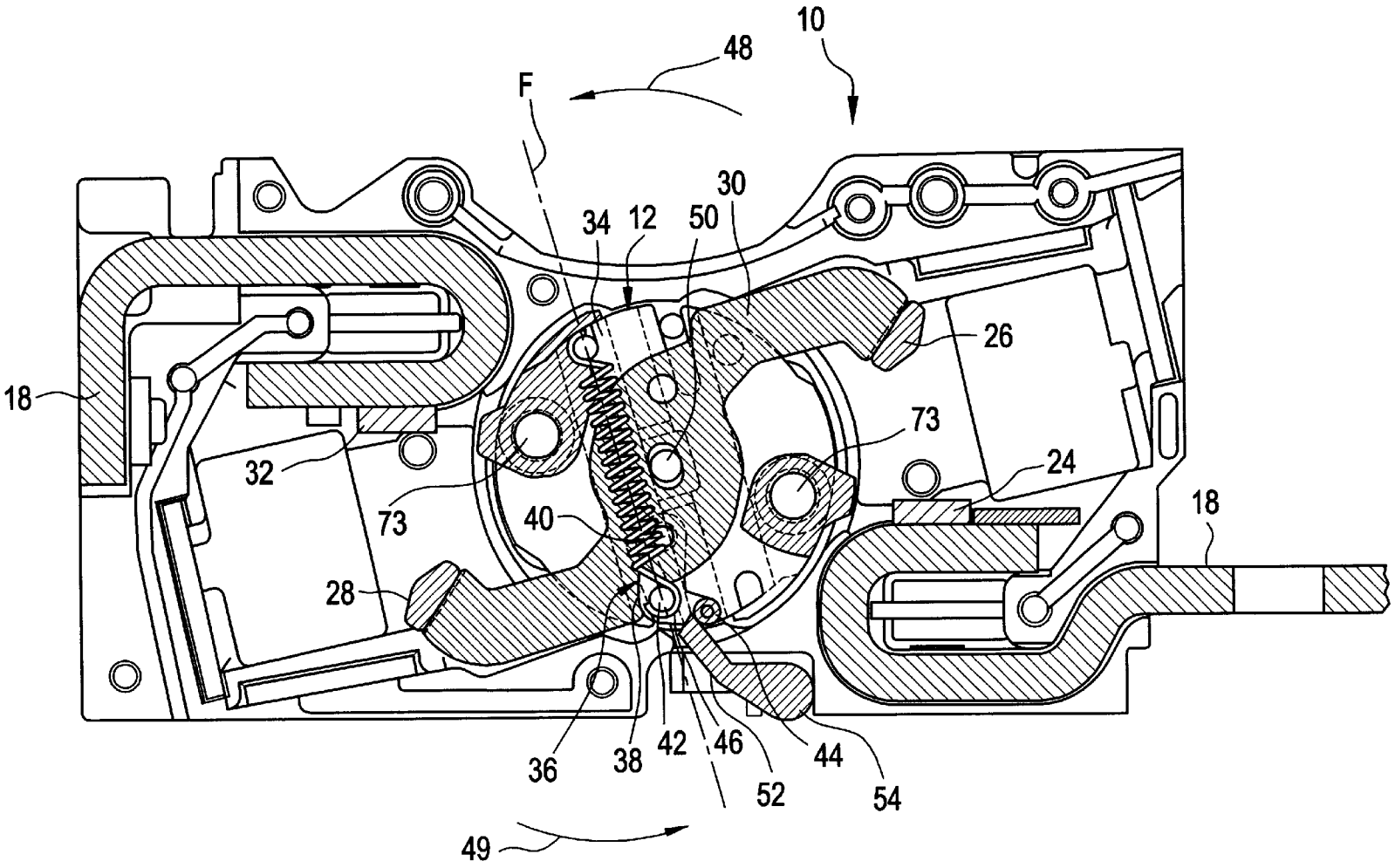
FIG. 3 is a side elevation view of the rotary contact assembly embodying the trip override device, of the present invention, showing the contacts in a tripped position.
Figure 4:
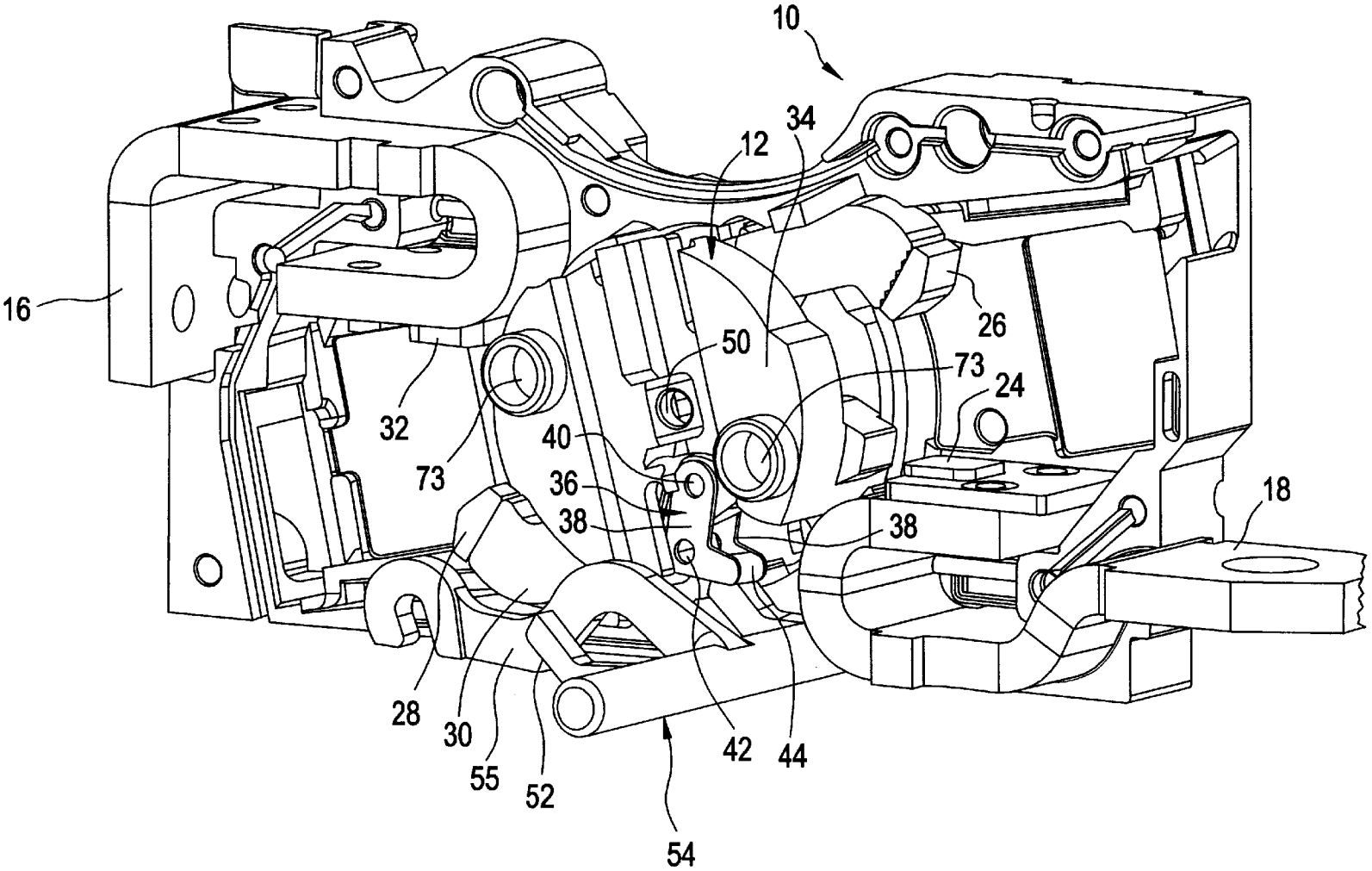
FIG. 4 is a perspective view of the rotary contact assembly embodying the trip override device, of the present invention, showing the contacts in a tripped position.

Referring now to FIGS. 3 and 4, rotary contact assembly 12 is shown with contact arm 30 in the "forced open" position as a result of an encountered overcurrent condition. As a result of this overcurrent condition, movable contacts 26, 28 and fixed contacts 24, 32 are separated by magnetic repulsive forces that occur between fixed contacts 24, 32 and movable contacts 26, 28. The forces caused by magnetic repulsion act against the forces created by the contact springs, which tend to maintain fixed contacts 24, 32 and movable contacts 26, 28 in a closed position. If the repulsive force exceeds the closing force created by the contact springs, contact arm 30 rotates in the direction of an arrow 48 while rotor 24 remains in a closed stationary or "on"position. The rotation of contact arm 30 moves pivot pin 40 in the direction of an arrow 49 around rotor pivot axle 50 in an arcuate path. As pivot pin 40 begins to move, the motion of pivot pin 40 along the arcuate path relative to slot 46 is transferred to spring pin 42, which translates along slot 46 toward an outer perimeter of rotor 34. Simultaneous with the arcuate movement of pivot pin 40 and the translation of spring pin 42 along slot 46, the second ends of L-shaped members 38 between which trip pin 44 is positioned pivot about pivot pin 40. As trip pin 44 pivots, it engages a trip lever 52 on a trip bar 54 that unarmes a circuit breaker operating mechanism 13 via a trip mechanism arm 55 or arm extending from the trip bar 54. The operating mechanism 13 opens all contacts in the circuit breaker and thereby stops the flow of electrical current through the circuit breaker for all poles disposed therein.

Figure 5:
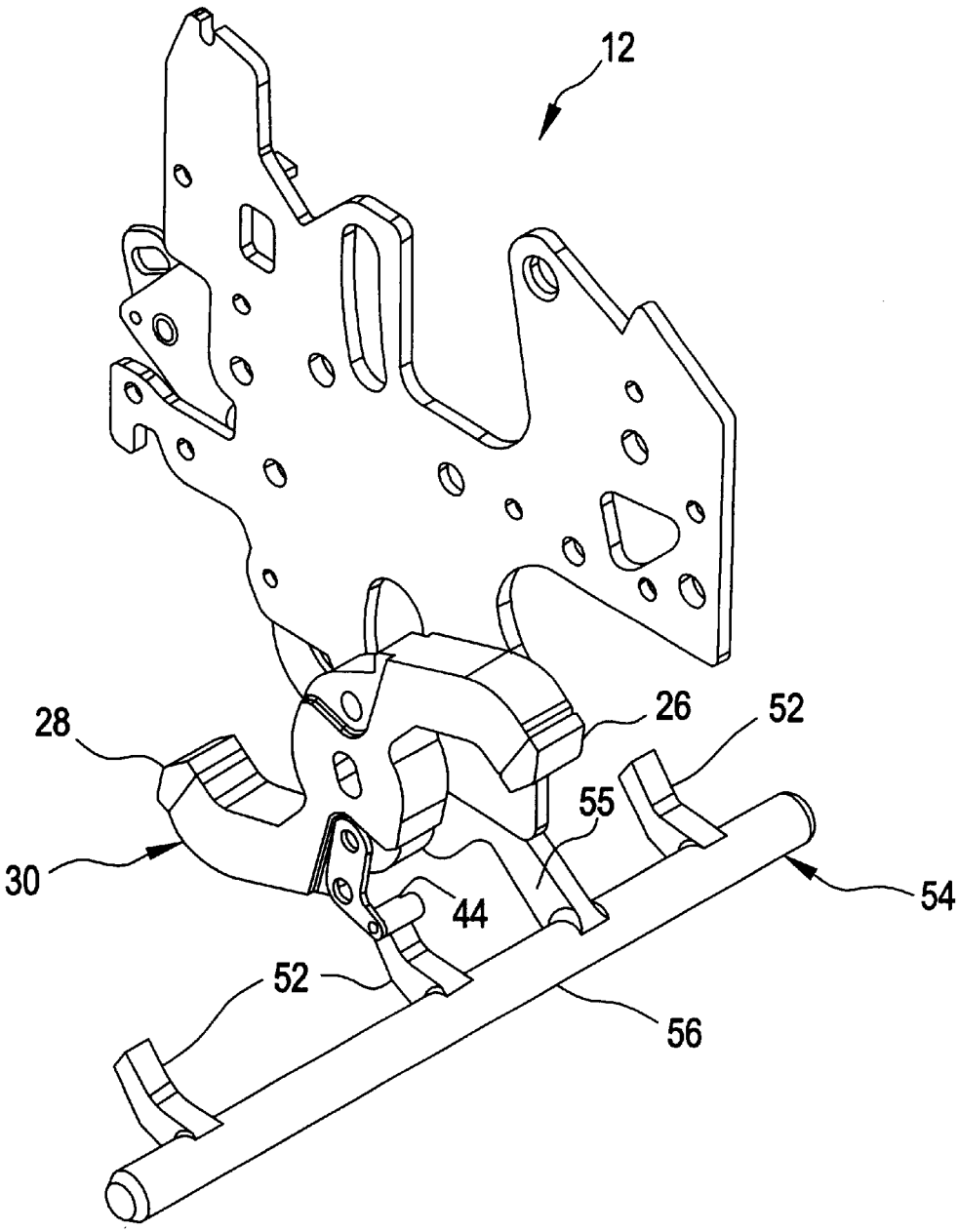
FIG. 5 is a perspective view of a spring link, of the present invention, attached to a contact arm and engaging a trip lever, of the present invention, on a trip bar, of the present invention.

Referring now to FIG. 5, a trip bar is shown generally at 54 and as it would be positioned relative to contact arm 30. Trip bar 54 comprises an elongated rod 56 having a plurality of trip levers 52 protruding radially therefrom. Trip rod 56 is rotatable about a longitudinal axis thereof such that each trip lever 52 pivots about the longitudinal axis of trip rod 56 and is engageable by a corresponding trip pin 44 associated with a corresponding rotary contact assembly. In an overcurrent condition associated with a single rotary contact assembly 12, trip pin 44 will engage trip lever 52, which will in turn axially rotate trip rod 56, thereby pivoting the trip mechanism arm 55 extending from trip rod 56.

Figure 6:
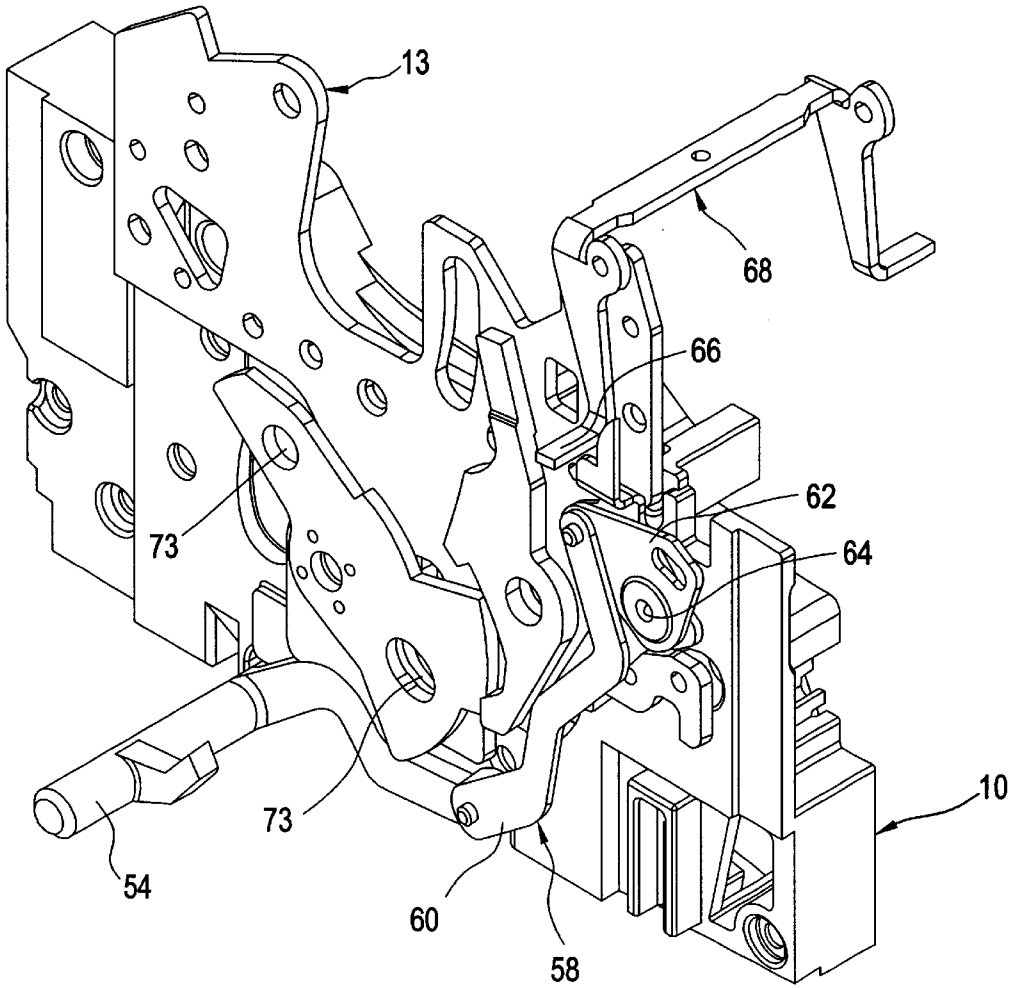
FIG. 6 is a perspective view of the trip bar, of the present invention, relative to a rotary contact assembly and a latching mechanism.

In FIG. 6, rotary contact assembly 12 having a circuit breaker operating mechanism 13 located thereon is shown. Circuit breaker operating mechanism 13 has an arm assembly 68. Rotary contact assembly 12 having circuit breaker operating mechanism 13 located thereon may be ganged together with other rotary contact assemblies. Arm assembly 68 is actuatable by the trip mechanism 58. In the event of a fault condition, such as an overcurrent in only a single pole of circuit breaker 10, trip mechanism 58 causes the tripping of all other poles of the circuit. Trip mechanism 58 is shown positioned on a side of rotary contact assembly 12. During operation of the circuit under a fault condition, trip bar 54 rotates causing trip mechanism arm 55 to pivot downward about trip bar 54. Trip mechanism arm 55 is pivotally engaged with a linkage element 60 of trip mechanism 58, which in turn causes a trip element 62 to pivot about a pivot point 64 and move a trip arm 66 of arm assembly 68. Movement of arm assembly 68 unarmes the operating mechanism 13, which causes the contacts associated with other poles of the circuit breaker to open and stop the flow of electrical current through that pole of the circuit breaker.

Figure 7:
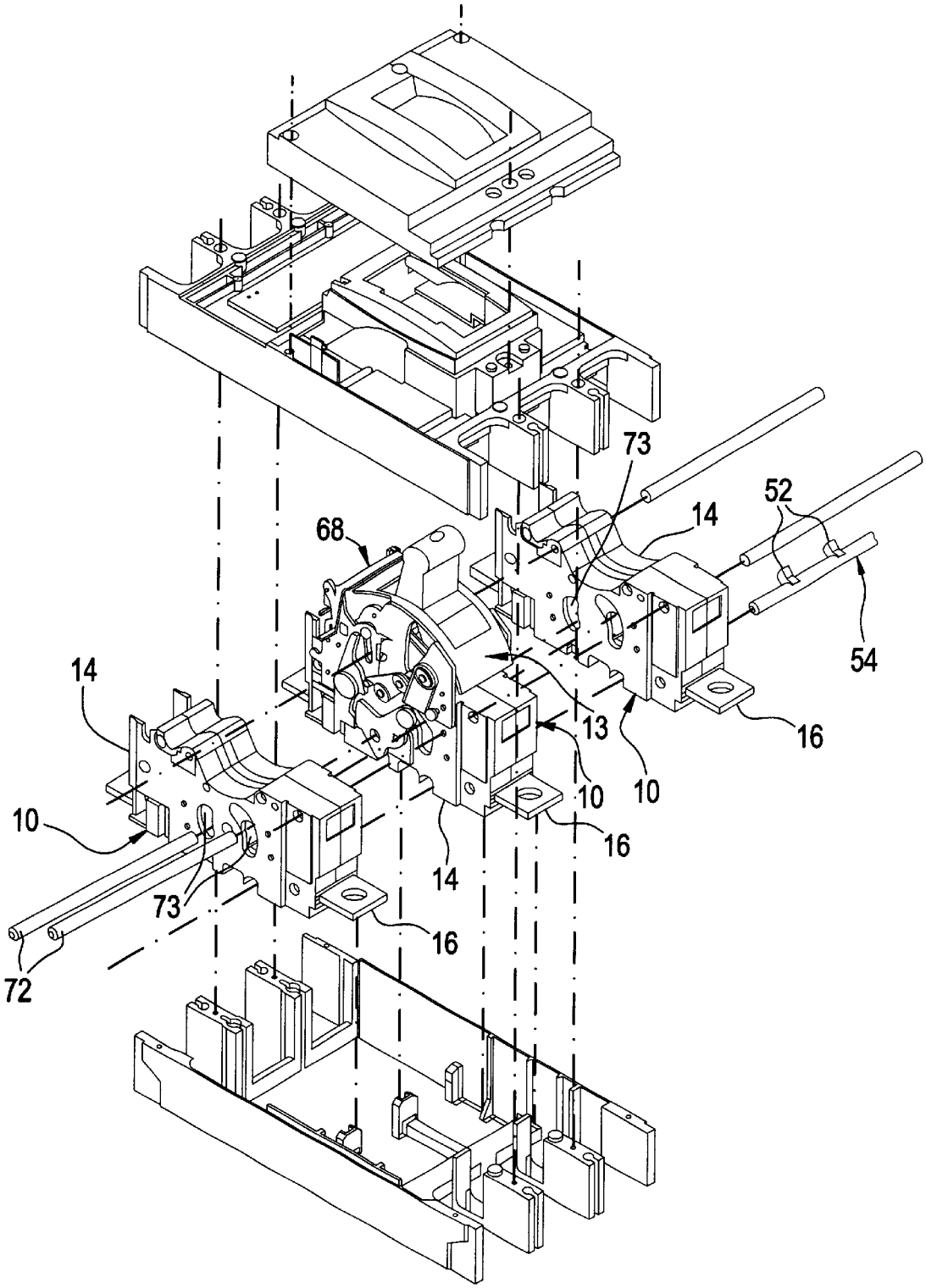
FIG. 7 is an exploded perspective view of three rotary contact assemblies, a circuit breaker operating mechanism, and a trip bar, of the present invention.

Referring now to FIG. 7, trip bar 54 is shown as it would be positioned relative to a plurality of cassettes 14 containing rotary contact assemblies 12 and circuit breaker operating mechanism 13 positioned atop one of cassettes 14. Rods 72 are disposed through holes 73 in rotary contact assemblies 12 to link rotors 34 to circuit breaker operating mechanism 13. It can be seen that when any one of the contact arms is forced open due to repulsive forces generated during an overcurrent condition, trip lever 52 is thrown, thereby causing trip bar 54 to rotate, which in turn causes circuit breaker operating mechanism 13 to unlatch. Because all rotors 34 are attached by rods 72, the pivoting of rods 72 about the pivot point of rotor 34 causes all rotors 34 to rotate and move the contacts in each pole from a closed position to an open position.

Trip bar 54, which comprises trip rod 56 and trip lever 52 depending from trip rod 56, is a part of a trip override system for circuit breaker operating mechanism 13, which allows contact separation in one pole to actuate the operating mechanism in all other poles in the circuit breaker. The above system has many advantages over the prior art, including that it functions independently of the system voltage by working off the mechanics of the rotor system.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A trip override device in mechanical communication with a pivotally mounted movable contact arm disposed within a rotor of a first rotary contact assembly and with a circuit breaker operating mechanism, the trip override device comprising:

a spring link pivotally connected at a first end to the movable contact arm;

a spring connecting an intermediate portion of said spring link to the rotor; and a trip bar having a trip lever extending therefrom, said trip lever being mechanically communicable with a second end of said spring link upon pivotal motion thereof while said rotor remains in a closed position, and said trip bar being in mechanical communication with the operating mechanism to operate a second rotary contact assembly.

2. The trip override device of claim 1 wherein said spring link includes, a first planar member and a second planar member configured to be in a spaced and parallel relationship with each other, said first planar member and said second planar member being pivotally mounted at first ends to the movable contact arm, a trip pin positioned between said first and said second planar members, said trip pin being connected proximate second ends of said first and said second planar members, and a spring pin positioned in termediate said first ends and said second ends of said first and said second planar members and between said first and said second planar members, said spring pin extending transversely through the planes thereof and projecting into and being slidably retained in a slot formed in each half of the rotor of the first rotary contact assembly surrounding the movable contact arm, said spring pin configured to receive said spring.

3. The trip override device of claim 1 wherein said trip bar includes, an elongated rod positionable so as to be communicable with the first rotary contact assembly and said second rotary contact assembly, an arm extending therefrom, said arm being communicable with the operating mechanism, and at least one trip lever protruding radially outwardly therefrom, said at least one trip lever being communicable with a first spring link of the first rotary contact assembly and another trip lever of said at least one trip lever being communicable with a second spring link of said second rotary contact assembly, one of said first and second spring links being cooperatively pivotally connected to a movable contact arm disposed in each of the first rotary contact assembly and said secondary rotary contact assembly.

4. The trip override device of claim 3 wherein said arm causes the pivotal rotation of a trip mechanism connected to the operating mechanism thereby causing the tripping of the circuit breaker operating mechanism.

5. A trip override device for operably connecting a movable contact arm disposed within a rotor of a first rotary contact assembly with a second movable contact arm of a second rotary contact assembly, the trip override device comprising:

a first means for actuating a trip bar in mechanical communication with the movable contact arm in a tripped position; and a second means for tripping the second rotary contact assembly at said tripped position.

6. The trip override device of claim 5 wherein said first means for actuating said trip bar on the first rotary contact assembly comprises, a spring link pivotally connected at a first end to the movable arm of the first rotary contact assembly, said spring link engageable with a circuit breaker operating mechanism while the rotor remains in a closed position, and a spring connecting an intermediate portion of said spring link to the rotor and providing biasing action thereto.

7. The trip override device of claim 6 wherein said spring link comprises, a first planar member and a second planar member configured to be in a spaced and parallel relationship with each other, said first planar member and said second planar member being pivotally mounted at first ends thereof to the movable contact arm of the first rotary contact assembly, and a trip pin disposed between said first and said second planar members, said trip pin being connected proximate second ends of said first and said second planar members, and a spring pin positioned intermediate said first ends and said second ends of said first and said second planar members and between said first and said second planar members, said spring pin extending transversely through the planes thereof and projecting into and being slidably retained in a slot formed in each half of the rotor of the first rotary contact assembly surrounding the movable contact arm of the first rotary contact assembly, said spring pin being configured to receive said spring.

8. The trip override device of claim 5 wherein said second means for tripping the second rotary contact assembly comprises, a trip bar having an arm protruding therefrom, said arm is operably connected to the operating mechanism, the operating mechanism is operably connected with the second rotary contact assembly, and said trip bar being mechanically communicable with said means for actuating said trip bar in communication with the first rotary contact assembly.

* * * * *

UNITED STATES PATENT AND TRADEMARK OFFICE

CERTIFICATE OF CORRECTION

PATENT NO. : 6,403,909 B1
DATED : June 11, 2002
INVENTOR(S) : Greenberg, et al.

It is certified that error appears in the above-identified patent and that said Letters Patent is hereby corrected as shown below:

Title page,
Item [75], after "Randall" delete "Green" and therefor -- Greenberg --
Item [75], after "Hassan," delete "Planville" and insert therefor -- Plainville --

Column 5,
Line 37, after "positioned" delete "in termediate" and insert therefor -- intermediate --

Signed and Sealed this

Fifteenth Day of October, 2002

*Attest:*

*Attesting Officer*

JAMES E. ROGAN
*Director of the United States Patent and Trademark Office*